US007762829B2

(12) United States Patent
Daily et al.

(10) Patent No.: US 7,762,829 B2
(45) Date of Patent: Jul. 27, 2010

(54) CONNECTOR ASSEMBLY FOR TERMINATION OF MINIATURE ELECTRONICS

(75) Inventors: Christopher George Daily, Harrisburg, PA (US); Charles Raymond Gingrich, III, Mechanicsburg, PA (US); Alan Weir Bucher, Manheim, PA (US)

(73) Assignee: Tyco Electronics Corporation, Middletown, PA (US)

( * ) Notice: Subject to any disclaimer, the term of this patent is extended or adjusted under 35 U.S.C. 154(b) by 259 days.

(21) Appl. No.: 11/965,237

(22) Filed: Dec. 27, 2007

(65) Prior Publication Data

US 2009/0170361 A1 Jul. 2, 2009

(51) Int. Cl.
*H01R 13/625* (2006.01)

(52) U.S. Cl. ..... 439/345; 362/294

(58) Field of Classification Search ..... 439/485–487, 439/345; 362/294, 373

See application file for complete search history.

(56) References Cited

U.S. PATENT DOCUMENTS 7,153,004 B2 * 12/2006 Galli ..... 362/373
2005/0024864 A1 2/2005 Galli
2006/0002125 A1 1/2006 Kim et al.

FOREIGN PATENT DOCUMENTS

WO WO 2006/118457 11/2006
WO WO 2007/034361 3/2007

OTHER PUBLICATIONS

PCT International Search Report; International Application No. PCT/US2008/013941; International Filing Date Dec. 18, 2008.

* cited by examiner

*Primary Examiner*—John A Ward

(57) ABSTRACT

Connector and connector assemblies for use with miniature high power electrical components, and specifically with miniature LEDs. Although the connectors and connector assemblies are designed for use with miniature LEDs, these devices are not so limited and can also be used with other miniature electronic devices. These connectors and connector assemblies provide a mechanical connection between the miniature electronic component and electrical contacts instead of a soldered connection, providing a reliable electrical contact between the component, whether used in a PCB-type drop-in connection or some other connection. The connector also includes a heat sink to remove heat from the connector assembly generated by the LED and provides for a reliable mechanical connection between the LED and heat sink.

20 Claims, 14 Drawing Sheets

CONNECTOR ASSEMBLY FOR TERMINATION OF MINIATURE ELECTRONICS

FIELD OF THE INVENTION

The present invention is directed to connector assemblies for miniature electronics, and specifically, to connector assemblies for use with miniature LEDS that include heat sinks.

BACKGROUND OF THE INVENTION

Light emitting diodes (LEDs) are used in a variety of applications and one class of these LEDs has been shrunk so that they can be used in miniature electronics, such as in surface mount applications. These miniature high power LEDs are assembled onto connectors or printed circuit boards (PCBs) as drop-ins, which are then soldered using reflow techniques to provide electrical contact. Difficulties can be encountered with soldering, as reflow can result in poor connections. But soldering also adds processing costs and complexity.

These assemblies are also limited with respect to the amount of heat that can be generated, as these assemblies do not incorporate heat sinks and heat dissipation capabilities are limited. The design operating temperature is an important factor in extending the life of an LED-based system, so either minimizing the heat generated, or moving the heat away for the LED can extend the life of the LED. Thus, electrical as well as thermal concerns are important to an effective design.

What is needed are connectors or connector assemblies for use with miniature LEDs so that the LED or LEDs can be assembled thereto without the need for soldering. In addition, these connectors or connector assemblies should include means to remove heat when such capability is required.

SUMMARY OF THE INVENTION

The present invention provides connector and connector assemblies for use with miniature electrical components, and specifically with miniature LEDs. Although the connectors and connector assemblies are designed for use with miniature LEDs, these devices are not so limited and can also be used with other miniature electronic devices. These connectors and connector assemblies provide a mechanical connection with the miniature electronic component that provides a reliable electrical contact between the component whether used in a PCB-type drop-in connection or some other connection. The mechanical connection eliminates the troublesome solder connections that have been used with miniature electronic devices. In addition, the heat sinks reliably remove heat, thereby providing these devices with higher current ratings and longer mean life ratings and usage.

The concept can be modularized, so that a heat sink of suitable size can be included with the connector to transfer heat away from the miniature electrical component. The heat sink component can be included integrally in the connector, or can be added as needed to form an assembly.

An advantage of the present invention is that it provides a connector that can be integrated into miniature electronics to form reliable connections without the complications and added costs of soldering.

Another advantage of the present invention is that it conveniently incorporates a heat sink into the connector design to move heat away from the miniature electronics, thereby preventing heat build-up as a result of heat generation from applied electrical current. This permits the miniature electronics device to operate either at a lower temperature or with higher power requirements (i.e. higher current ratings), or both.

Yet another advantage of the present invention is that high power LED assemblies with heat sinks can be mounted remotely from the driver electronics, allowing the light output to be directed where it is needed.

Still another advantage of the present invention is that assembly is simplified, as the connection between the connector and the miniature electronic device is a simple mechanical connection. This permits existing miniature electronic devices to be assembled with a mechanical connection to provide a reliable electrical contact, and eliminates the necessity of soldering the miniature electronic device to establish an electrical contact.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
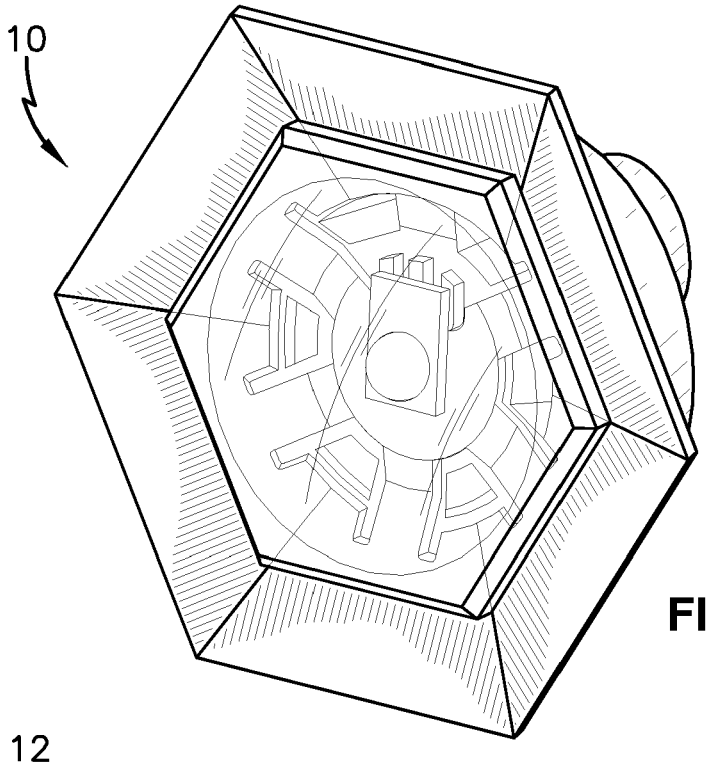
FIG. 1 is a perspective of an embodiment of a connector assembly of the present invention.
Figure 2B:
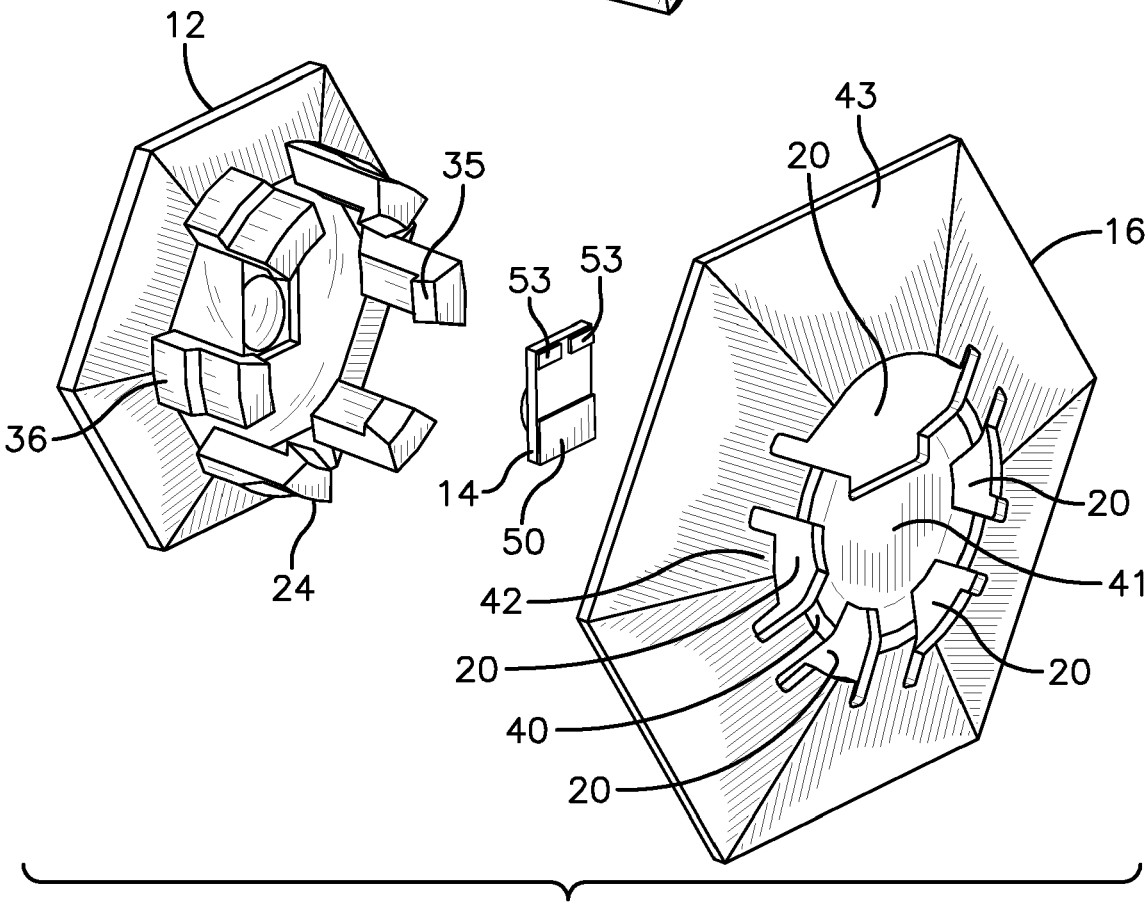
FIG. 2B is an exploded view of the connector assembly of FIG. 1 from a second view, omitting some parts for clarity.
Figure 2A:
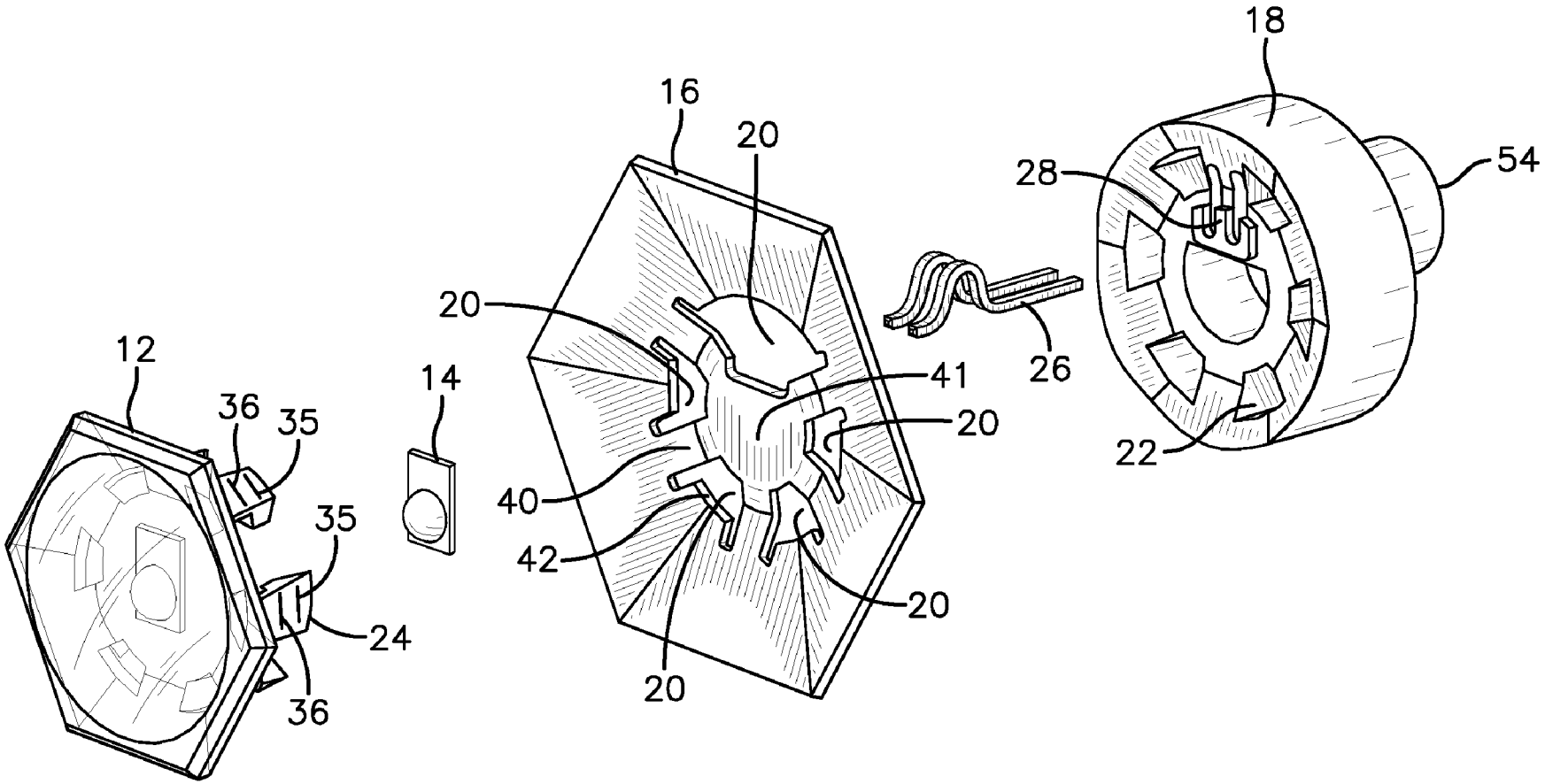
FIG. 2A is an exploded view of the connector assembly of FIG. 1.
Figure 2C:
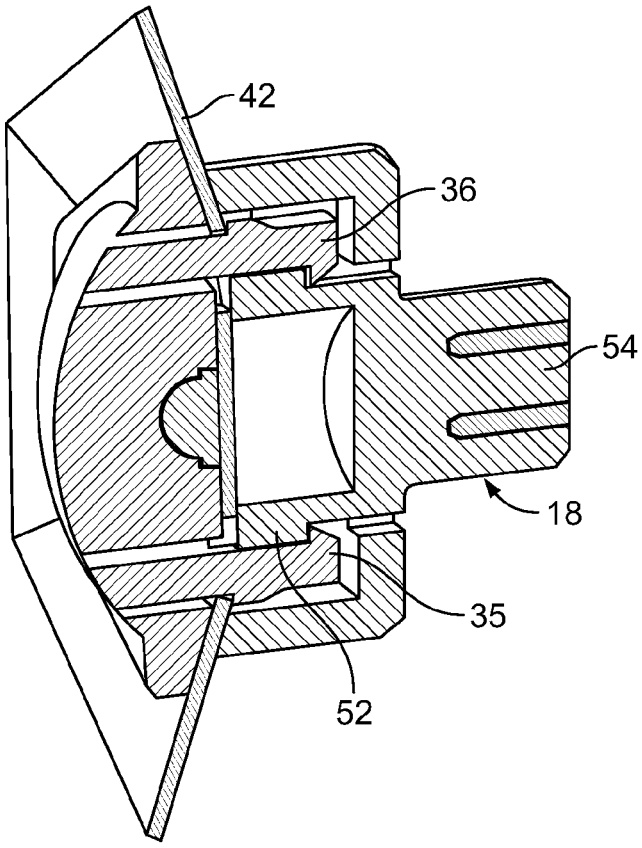
FIG. 2C is a cross-sectional view of the connector assembly of FIG. 1 through the latch structure.
Figure 2D:
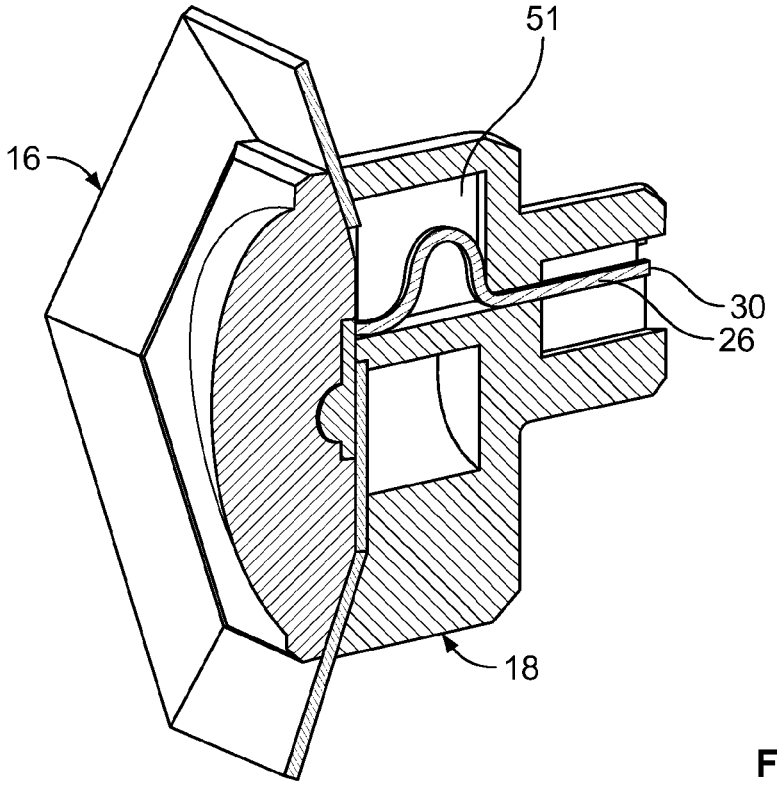
FIG. 2D is a cross-sectional view of the connector assembly of FIG. 1 through the power contacts.
Figure 3:
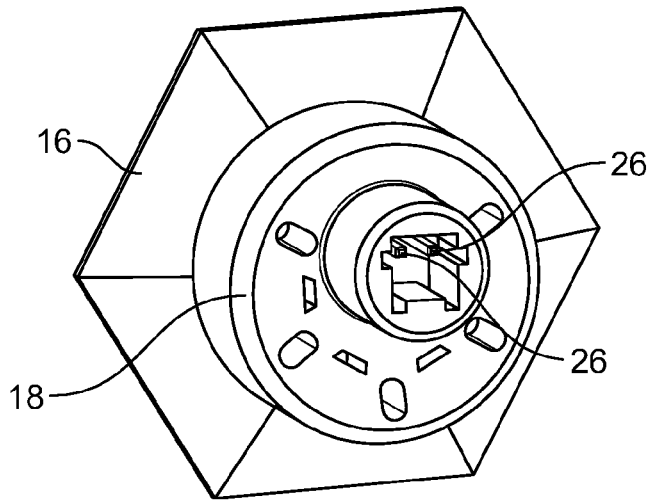
FIG. 3 is a back view of the connector assembly of FIG. 1 depicting the power contact connections.
Figure 4:
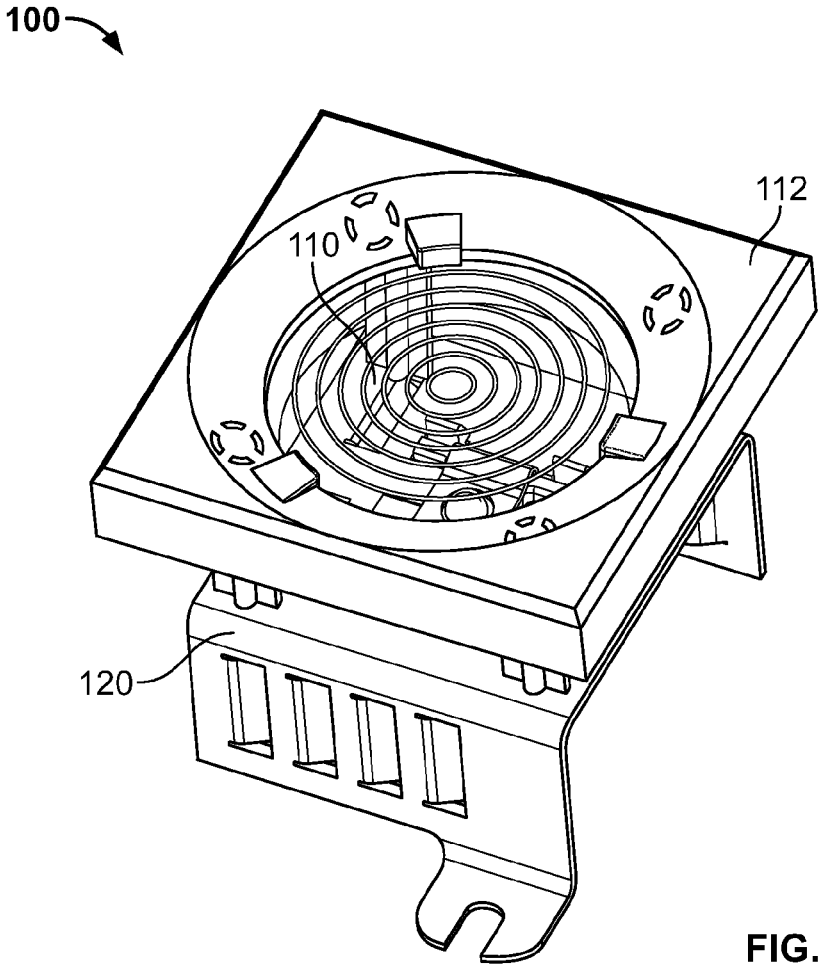
FIG. 4 is a perspective view of a second embodiment of a stamped connector assembly of the present invention.

FIG. 1 is an embodiment of the present invention that depicts a connector assembly 10 that includes a heat sink assembly. FIG. 2A is an exploded view of assembly 10 that comprises a lens/LED nest 12 assembled over a miniature LED 14 (miniature LEDs include small surface mountable LEDs such as the LUXEON® Rebel available from Philips Lumileds Lighting Company of the Netherlands and with facilities in San Jose, Calif.), holding LED 14 against heat sink/optical reflector 16 comprising a thermally conductive material. Lens 12 is an optically clear thermoplastic. While shown in FIG. 1 as having a hexagonal shape, the reflector 16 and lens 12 be any convenient preselected geometry for a particular application, so that it can be round, octagonal, etc. Reflector 16 includes a plurality of arms 40 between apertures 20 that link a center raised pad 41 to the periphery of reflector 43. Reflector 16 also includes a plurality of tabs 42 located between each pair of arms 40 extending slightly into apertures 20. Lens 12 includes a plurality of latches 24, each latch including a first tooth 35 near its end, and a second tooth 36 nearer to the base of the latch on the opposite side of the latch 24 from the first tooth 35. The latches 24 are inserted through apertures 20, with each latch flexing inward as its second tooth 36 encounters the adjacent reflector tab 42. As the heat pad 50 of the LED 14 engages the center pad 41 of the reflector 16, the arms 40 flex and center pad 41 exerts a force on the LED heat pad 50. When fully inserted, each latch 24 springs back toward its free state and the second tooth 36 engages tab 42, thus retaining lens 12 with pressure between center pad 41 and LED heat pad 50 as shown in FIG. 2C. Arms 40 provide multiple thermally conductive paths between center raised pad 41 and periphery 43 of reflector 16 to guide heat away from LED 14. Referring to FIGS. 2A, 2B, 2C and 2D, power contacts are inserted through a plurality or second set of apertures 28 of connector back 18, the ends of power contacts 26 extending from either side of connector back 18, as evident from FIG. 3 on the power connection side, and toward LED side as evident in FIG. 2D. The second set of apertures 28 include walls 51 that prevent power contacts 26 from being pressed completely through connector back 18. Assembly continues as lens latches 24 are inserted through apertures 22, with each latch 24 flexing outward as its first tooth encounters the side of aperture 22. As latches 24 are inserted, power contacts 26, supported by walls 51, engage LED power pads 52 and provide an electrical path between LED 14 and power connection portion 54 of connector back 18. When latches 24 are fully inserted, each latch 24 springs back toward its free state as it engages a relieved mating ledge 52 in connector back 18, thus retaining the assembly against the force of the mated power pins 26. The first tooth 35 and second tooth 36 are on opposite sides of latch 24 so that engagement of second tooth 36 to tab 42 is not loosened as latch 24 flexes to engage first tooth 35. The ends 30 of power contacts extending from the connector back 18, see FIG. 2D and FIG. 3, can be attached to power wiring. The connector back 18 can be compatible with the commercially available Tyco Electronics Mini-CT connector, available from Tyco Electronics, Middletown, Pa.

Heat sink/optical reflector 16 is comprised of a thermally conductive material, preferably stamped or formed from aluminum or stainless steel, although it can be comprised of a thermally conductive polymer. It conducts heat away from the LED to its outer surfaces, where the heat can then be removed by the natural convective flow of air over the heat sink optical reflector. It also reduces heat build up from the assembly as a reflector, which reflects radiant energy in the form of light away from the assembly, rather than absorbing it.

Figure 5:
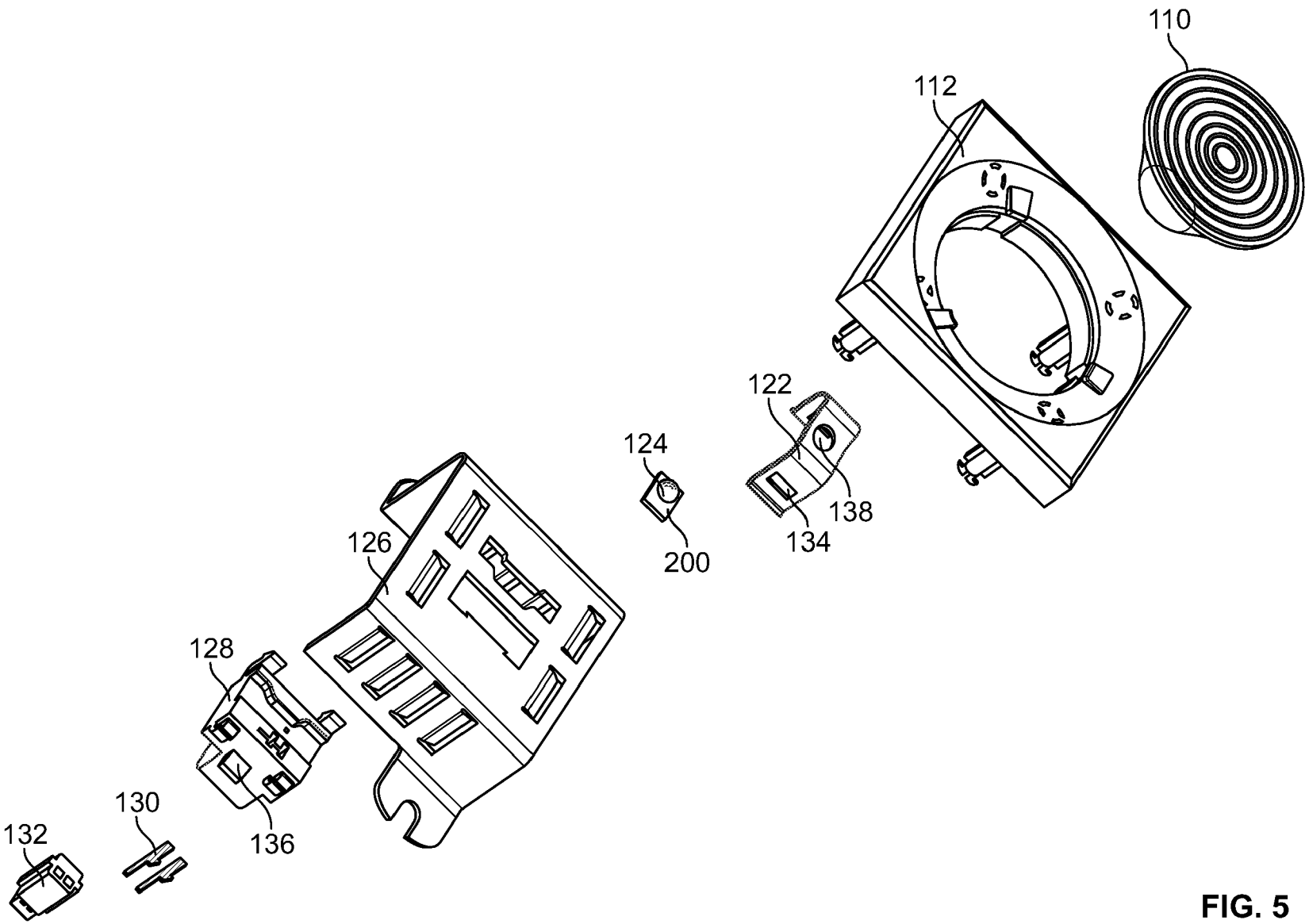
FIG. 5 is an exploded view of the connector assembly of FIG. 4.
Figure 6:
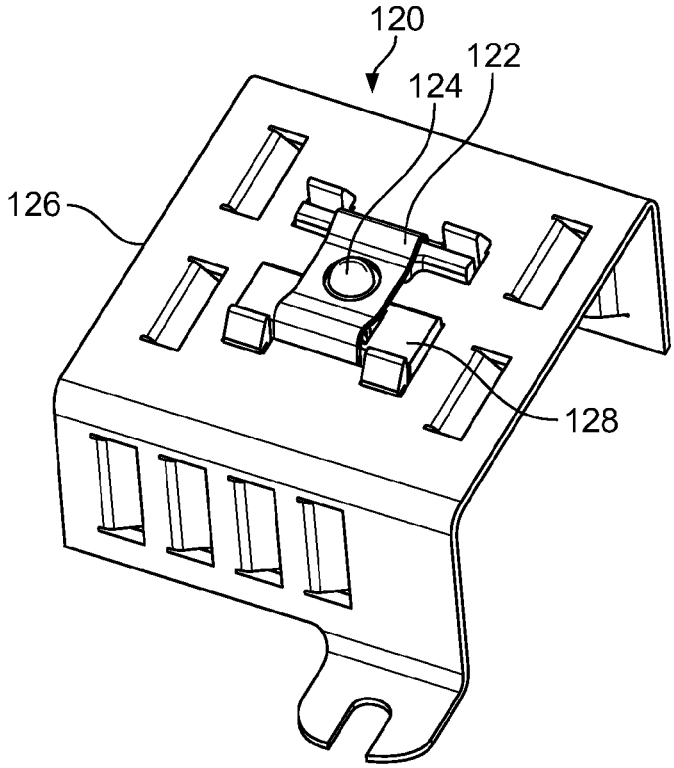
FIGS. 6-9 are perspective views of the connector assembly of FIGS. 4 and 5 at various stages of assembly.
Figure 7:
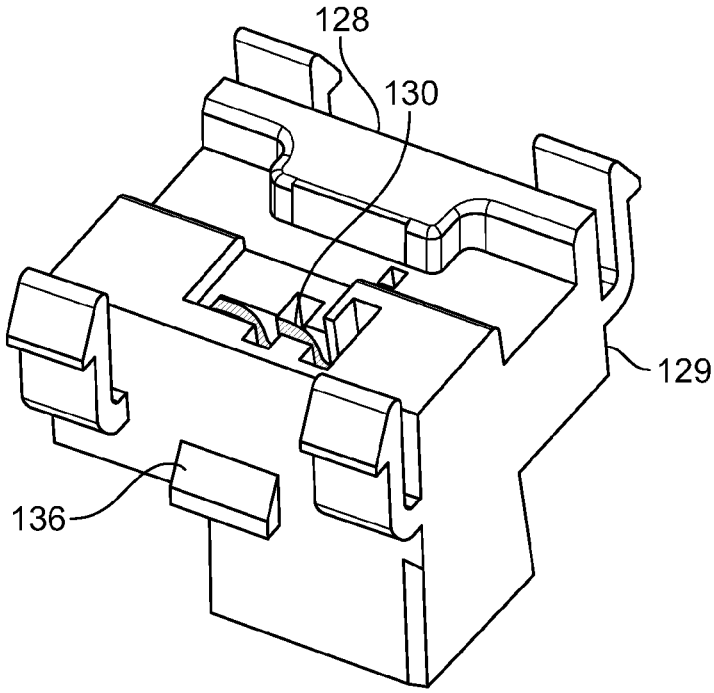
Figure 8:
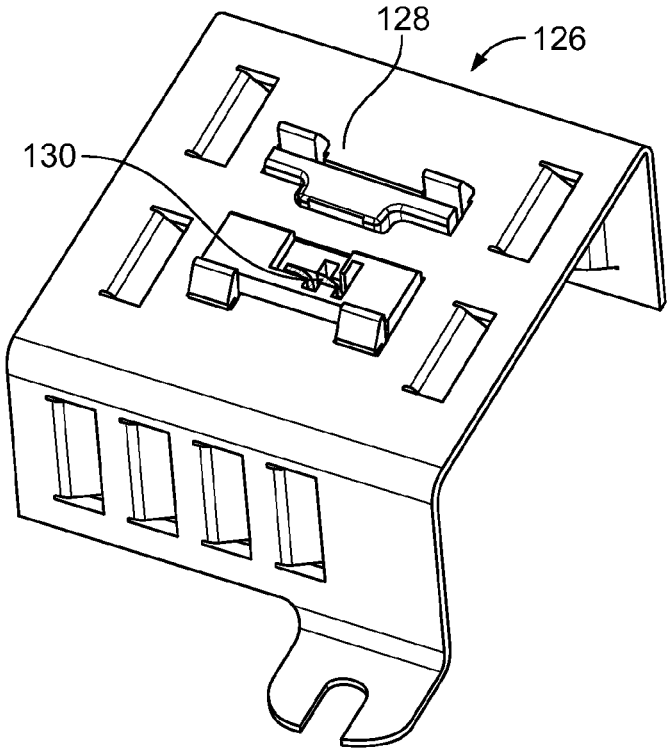
Figure 9:
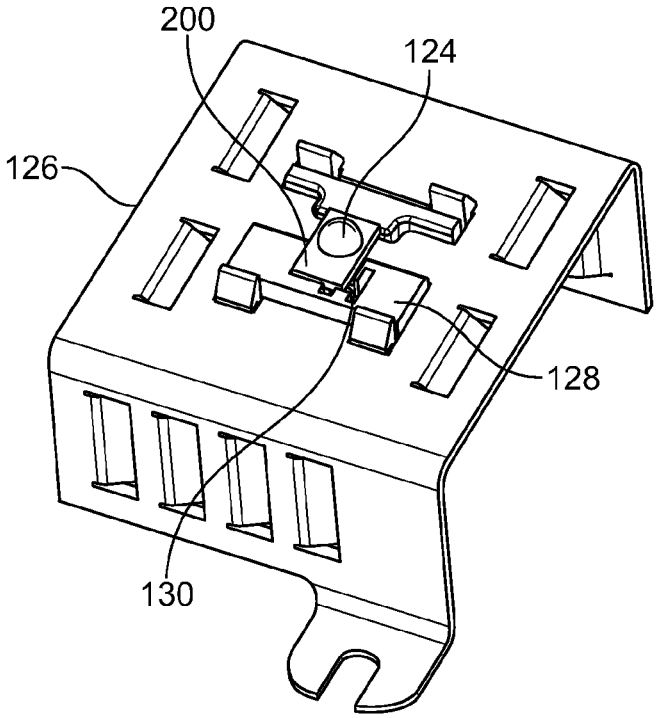

A second embodiment of the present invention is depicted in FIGS. 4-11. This embodiment is the LED stamped connector assembly 100 comprising a Carclo lens 110 assembled to a thermoplastic lens carrier 112, which is assembled over a heat sink assembly 120. An exploded view of LED stamped connector assembly 100 is depicted in FIG. 5. Heat sink assembly 120, shown in FIG. 6 is comprised of stamped heat sink 126 through which is mounted a plastic contact carrier 128 into which is assembled compliant power contacts 130, more clearly visible in FIGS. 8 and 10. A contact carrier assembly 129 comprising the compliant power contacts 130 assembled into the plastic contact carrier 128 is shown in FIG. 7. The contact carrier assembly 129 snaps into the aperture pattern on the top face of stamped heat sink 126 as shown in FIG. 8. An LED 124 is positioned into a locator pocket molded into plastic contact carrier 128, as depicted in FIG. 9. Referring back to FIGS. 5 and 6, a retention clip 122, preferably of stainless steel is assembled over LED and snapped into position around the plastic contact carrier. The retention clip 122 includes a pair of apertures 134 (only one of which is visible) that engages protrusion or bump 136 on plastic contact carrier, FIGS. 5 and 7. Once engaged, LED is visible through the cut out 138 in top surface of retention clip 122. Retention clip 122 provides a downward force on LED 124, which urges LED into mechanical contact with compliant contacts 130 and heat sink 126.

Figure 10:
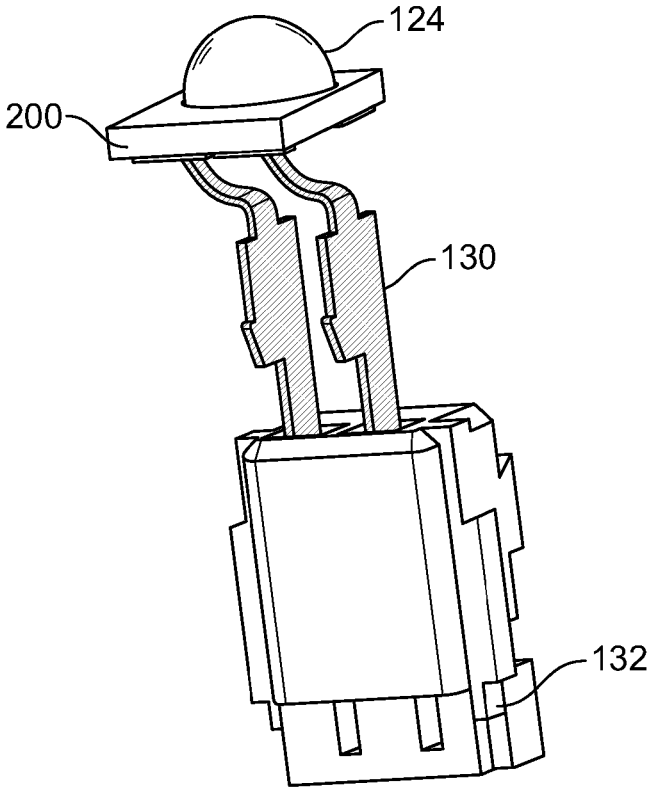
FIG. 10 depicts compliant contacts between the LED and a Mini-CT connector, without a stamped heat sink.
Figure 11:
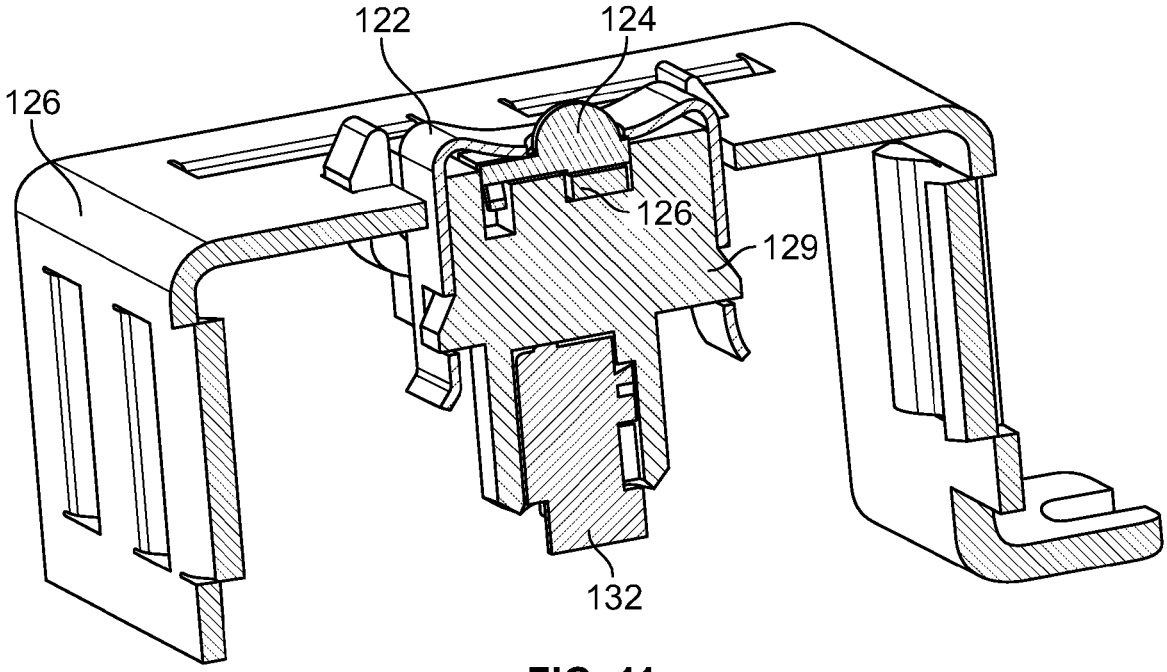
FIG. 11 is a cross sectional view of the connector assembly of FIG. 6.

The compliant contacts 130, urged into contact with the LED 124, are in communication with a power source. The compliant contacts can be mated to a PCB, which can power them. Alternatively, the compliant contacts 130 can be hardwired to a power source. As shown in FIGS. 5 and 11, contact carrier assembly 129 is mated to a Mini-CT connector 132, which is connected to a power source. FIG. 10 shows the detail of the connection of the compliant contacts 130 between LED 124 and Mini-CT connector 132, the plastic contact carrier 128 having been removed from this view for clarity. FIG. 11 is a cross sectional view of the contact carrier assembly 129 assembled to heat sink 126 and to Mini-CT connector 132.

Figure 12:
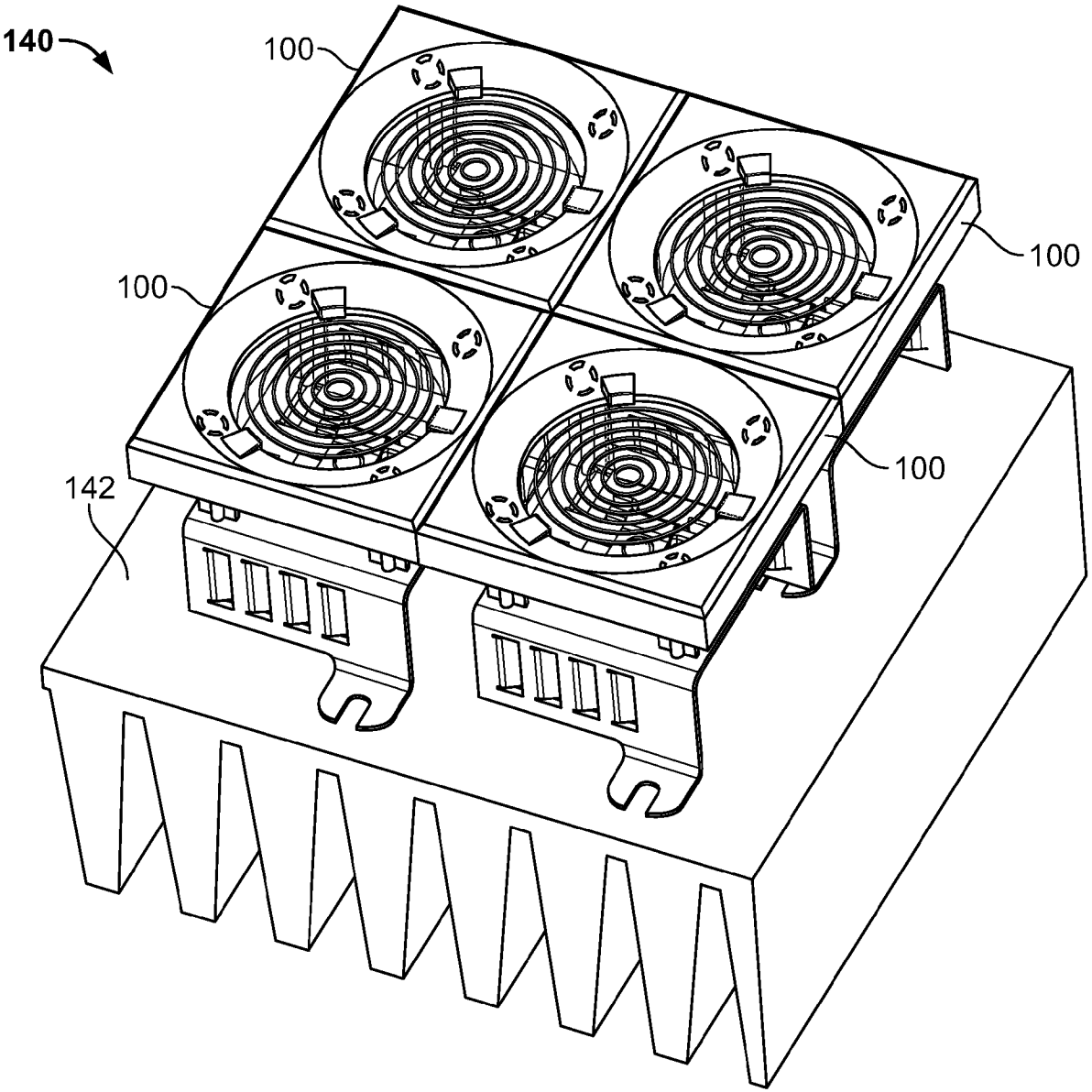
FIG. 12 depicts a 2×2 array of the connector assembly of FIG. 4 assembled onto a light fixture heat sink.

In the design depicted in FIGS. 4-11, light generated by miniature LED 124 is directed by lens 110. To reduce heat buildup, heat is conducted away from LED 124 by stamped heat sink 126, which dissipates the heat. Retention clip 122 is a metal, which imparts a normal force on LED 124 to urge it into contact with compliant power contacts 130, while pad 200, integral with LED 124, is urged into contact with heat sink 126. It is preferably a metal that has a high mechanical strength such as a stainless steel alloy, although in certain applications, other metals may be used. Stamped heat sink 126 preferably is a metal that has high thermal conductivity and can be formed by stamping, such as a stainless steel alloy, an aluminum or aluminum alloy or a copper and copper alloy. However, it may also be a conductive polymer. Stamped heat sink 126 includes feet that allow heat sink assembly 120 to be securely but removably mounted to a surface, such as a PCB surface or a light fixture heat sink 142, such as depicted in FIG. 12 that is provided with features to capture heat sink 126. FIG. 11 is a cross-sectional view of the assembly of FIG. 6. This view shows the interface between the retention clip 122, LED 124 and contact carrier 128. Retention clip applies the force to enable a reliable mechanical contact between LED 124 and compliant contacts, as well as between LED 124 and stamped heat sink 126.

The stamped connector assembly 100 can be arranged into an array formed from a plurality of connector assemblies 100. A simple 2×2 array 140 is depicted in FIG. 12, but this array can be expanded to any desired size. The array can be assembled onto a light fixture heat sink 142 to enhance heat dissipation, to allow the LEDs to be operated at even higher currents.

Figure 13:
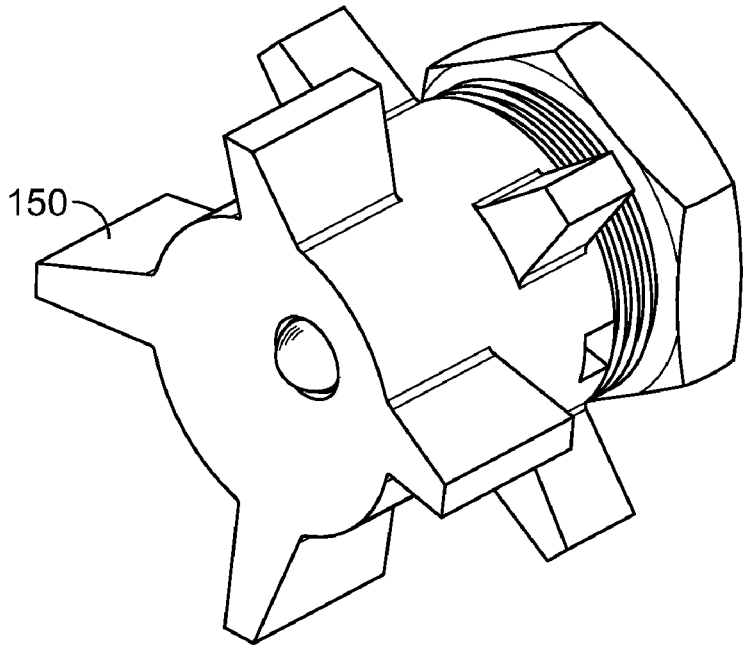
FIGS. 13 and 14 depict a perspective front view and back view of a third embodiment of the present invention.
Figure 14:
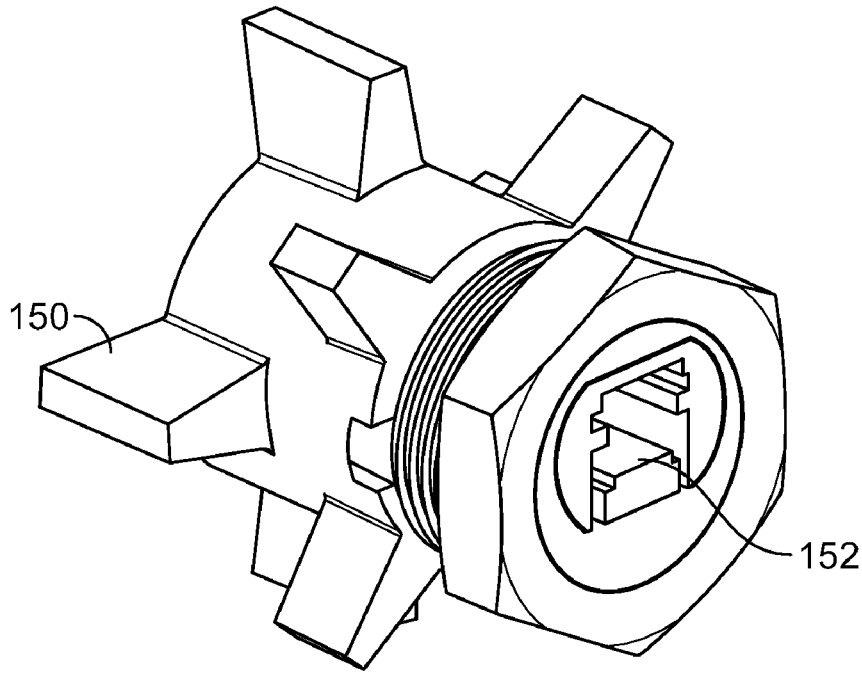

FIGS. 13 and 14 depict a third embodiment of the present invention. An LED connector heat sink assembly 150 is depicted in FIG. 13. The back end of the LED connector heat sink assembly 150 is shown in FIG. 14. The back end 152 is a Mini-CT connector-compatible, permitting a Mini-CT connector to be inserted into the back end 152.

Figure 15A:
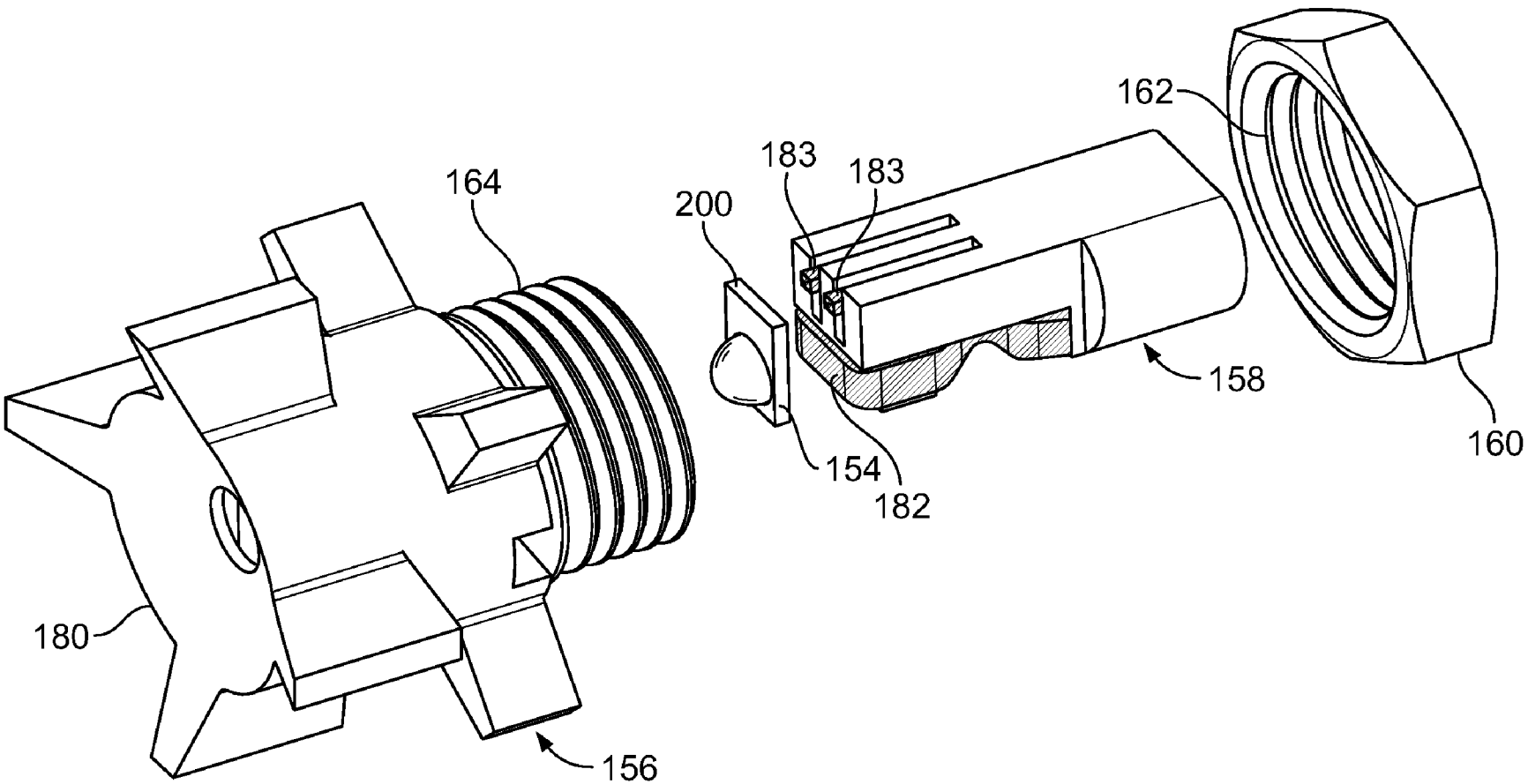
FIG. 15A is an exploded view of the embodiment of FIG. 13.
Figure 15B:
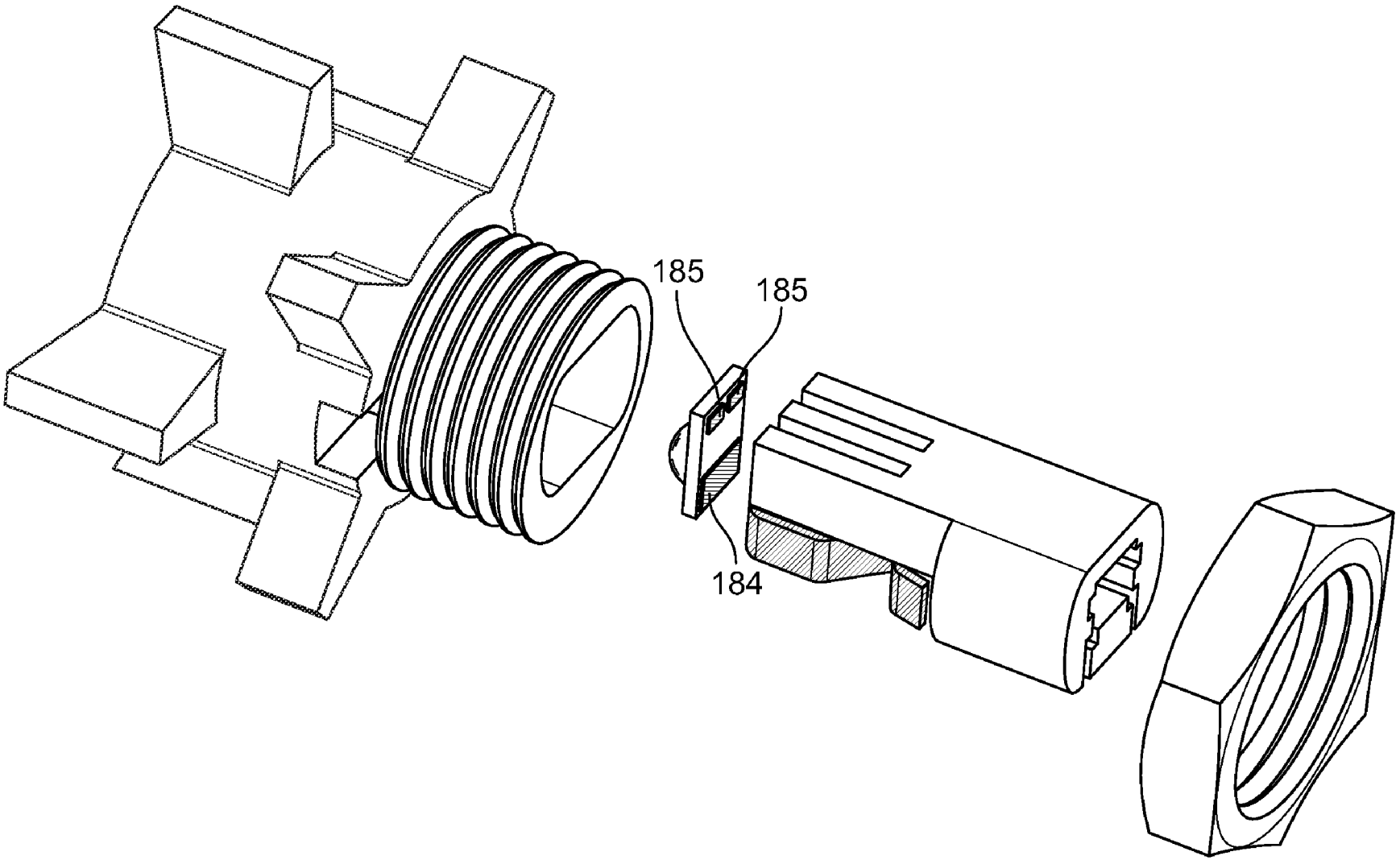
FIG. 15B is an exploded view of the embodiment of FIG. 13 from a second angle or perspective.

An exploded view of the LED connector heat sink assembly 150 is depicted in FIGS. 15A and 15B. Connector heat sink assembly 150 comprises a miniaturized LED 154, such as the Rebel LED discussed previously. The miniaturized LED 154 is inserted into and positioned in heat sink body 156 and is held in place by contact cartridge assembly 158. An optional mounting nut 160 having threads 162 may be threaded over optional mating threads 164 on the exterior of heat sink body 156, to mount the connectorized heat sink to a panel.

Figure 16:
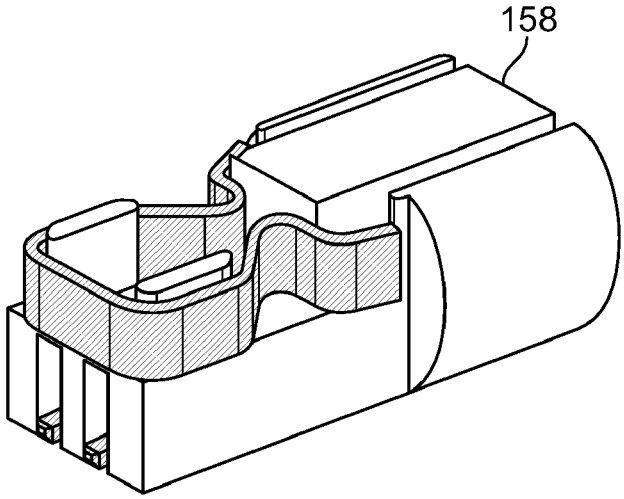
FIG. 16 depicts a reverse detail view of the contact cartridge assembly of FIG. 15A.
Figure 17:
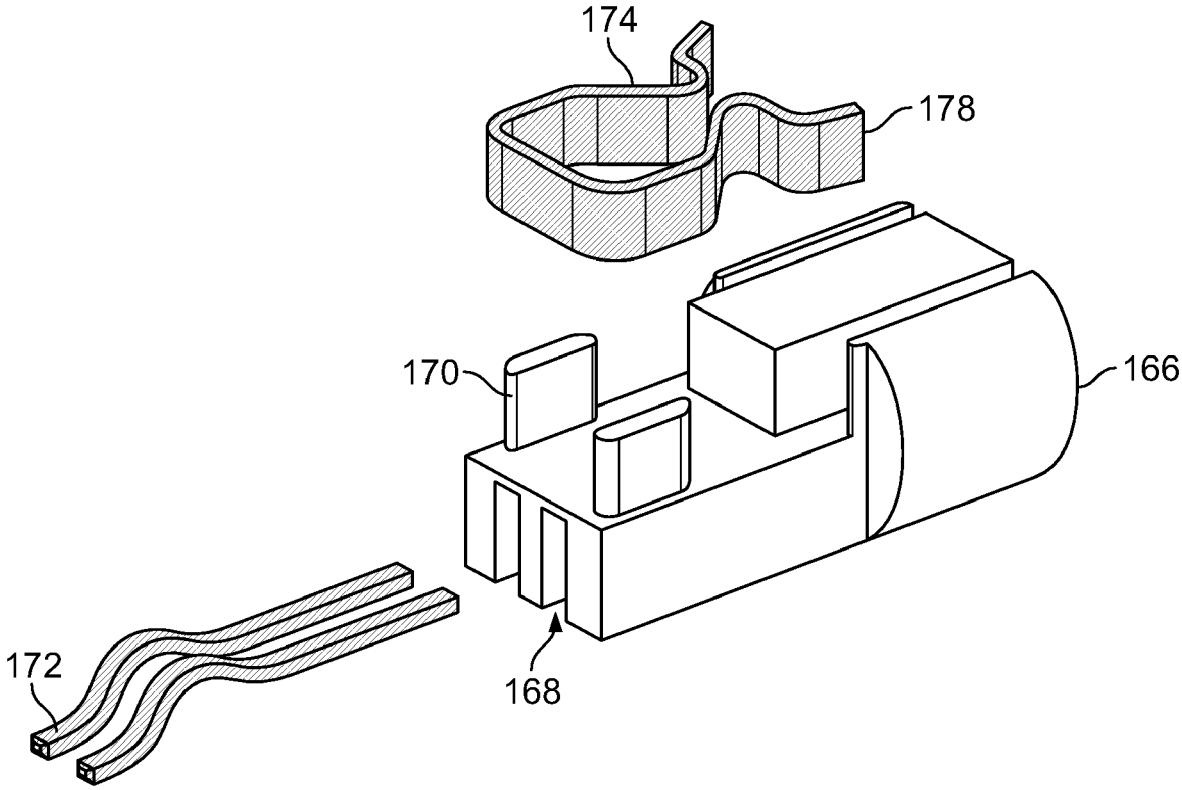
FIG. 17 is an exploded view of the contact cartridge assembly of FIG. 16.

Contact cartridge assembly 158 is depicted in FIG. 16, and in exploded view in FIG. 17. Contact cartridge assembly 158 includes a plastic cartridge body 166 that includes a pair of slots 168 extending through the body and tabs 170 extending away from the body opposite the slots. Slots 168 accept compliant power contacts 172 that are positioned therein and which extend from either end of cartridge body 166. Compliant thermal contact/retention clip 174, comprising a thermally conductive spring like material, is inserted over tabs 170 of cartridge body 166.

Figure 18:
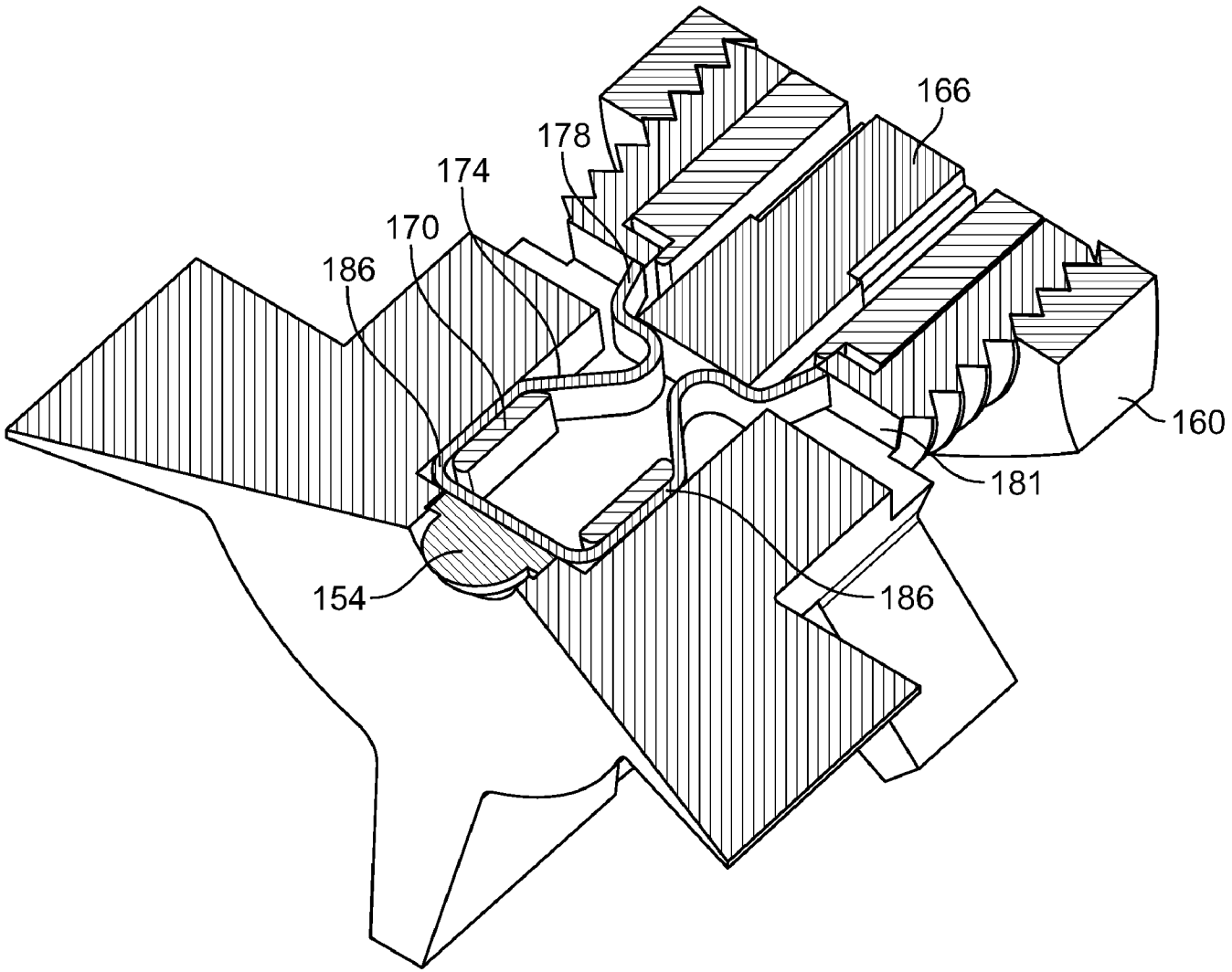
FIG. 18 is a cross-sectional view of the connector assembly of FIG. 13.

Referring to FIG. 18, which is a cross-sectional view of LED connector heat sink assembly 150, LED 154 is inserted into heat sink body 156, where LED 154 is visible through an aperture. Contact cartridge assembly 158 is inserted into heat sink body 156, capturing LED 154 within heat sink body 156 so that LED 154 is positioned in a central aperture of heat sink body 156. The compliant thermal retention clip 174 is driven against LED 154 as contact cartridge assembly 158 is inserted. Arms 178 of compliant thermal retention clip 174 spring outwardly, engaging retention features 181 in a counterbore in heat sink body 156, the counterbore configured to accept an end of cartridge assembly 158 that includes retention clip 174. Thus, a force is exerted that keeps thermal contact region 182 of thermal retention clip 174 in contact with LED heat pad 184, and keeps power contact tips 183 in contact with power pads 185, as shown in FIGS. 15A and 15B. It further maintains sides 186 of compliant thermal retention clip 174 in contact with the inside surface of heat sink body 156, thus providing the thermal conduction path from the LED 154 to the heat sink body 156. Power contacts 172 may be wired to a power source or may plug into a PCB from which it derives power.

Heat sink body 156 has a central aperture extending longitudinally through the body from a first end to a second end and may be comprised of any thermally conductive material such as a conductive metal, including but not limited to stainless steels, aluminum and its alloys, and copper and its alloys, or of a thermally conductive resin. When the heat sink body comprises a conductive metal, some minor modifications within the skill of the art are required to electrically isolate the heat sink body 156 from the power contacts 172 of contact cartridge assembly. The heat sink body 156 has a predetermined fin pattern extending axially from the body for axial and cross-flow of air to facilitate removal of heat from the heat sink body 156. Preferably, the heat sink body has a concave conical face to maximize fin area without encroaching on the light path from the LED 154. This conical face can be coated with a reflective material to further maximize the light output of assembly 150. Heat from power losses in LED 154 is transferred to heat sink body 156 through the compliant thermal retention clip 174, which moves heat away from LED 154 and transfers the heat to air passing over the outer surfaces of heat sink body 156. A more effective transfer of heat away from the LED 154 and heat sink body 156 results in a higher current rating for LED connector heat sink assembly 150.

The present invention can be used with small LEDs, including small surface mountable LEDs such as the LUXEON® Rebel available from Philips Lumileds Lighting Company of the Netherlands and with facilities in San Jose, Calif. The present invention also can be used with the Tyco Electronics Mini CT connectors available from Tyco Electronics, Middletown, Pa.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An assembly for use with miniature electronic components, comprising a miniature LED, the miniature LED including a heat pad and power pads;

an optical reflector having a preselected geometry to direct light in a direction determined by the geometry, the reflector further including a raised pad connected to a reflector body by a plurality of arms that form apertures in the reflector, the raised pad configured to engage the heat pad on the LED;

a lens having a preselected geometry that matches the geometry of the optical reflector, the lens including a plurality of latches that extend between the arms and through the apertures of the optical reflector, the reflector capturing the LED between the reflector and the lens, while exerting a force on the LED to maintain the LED heat pad in contact with the reflector raised pad;

a connector back having two sides and housing at least two power contacts extending from the sides, the power contacts supported to minimize movement in the connector back, the connector back further including a plurality of apertures corresponding to the lens latches, the power contacts connected to a power source on one side;

wherein the plurality of lens latches further engaging the plurality of apertures in the connector back to capture the lens, urging the LED power pads against the power contacts; and wherein the plurality of arms provide a path for the conduction of heat from the LED through the LED heat pad to the reflector, the reflector functioning as a heat sink to transfer heat from the LED.

2. The assembly of claim 1 wherein the reflector is a thermally conductive material.

3. The assembly of claim 2 wherein the reflector is a stainless steel material.

4. An assembly for use with miniature electronic components, comprising:

a contact carrier assembly, wherein the contact carrier assembly includes a contact carrier having a pocket on a top surface, and power contacts having one end in communication with a power source, the power contacts extending through the contact carrier with an opposite end extending through its top surface;

a miniature LED, the miniature LED including a heat pad and power pads, the LED housed in the pocket of the contact carrier;

a heat sink body having a top face that includes an aperture pattern, wherein the contact carrier assembly extends through the aperture pattern on the top face of the heat sink assembly;

a retention clip having an aperture assembled over the LED, the retention clip captured by the contact carrier, wherein the captured retention clip exerts a force on the LED urging it into contact with the power contacts and heat sink body;

a thermoplastic lens carrier assembled to the heat sink body; and a lens fitted into the lens carrier and over the LED.

5. The assembly of claim 4 wherein the power contacts having one end in communication with a power source further includes a connector that provides a connection between the power contacts and the power source, the connector having an interface compatible with the contact carrier assembly.

6. The assembly of claim 4 wherein the heat sink body comprises a thermally conductive material.

7. The assembly of claim 6 wherein the heat sink body comprises aluminum and alloys thereof.

8. The assembly of claim 4 wherein the retention clip comprises a material having high mechanical strength.

9. The assembly of claim 8 wherein the retention clip comprises stainless steel.

10. The assembly of claim 4 further comprising a plurality of the miniature LEDs arranged in an array.

11. An assembly for use with miniature electronic components, comprising:

a heat sink body having an aperture extending longitudinally through the body from a first end to a second end, a counterbore in a first end of the body having retention features, and a predetermined fin pattern extending radially from the body, the heat sink body comprising a thermally conductive material;

a contact cartridge assembly further including a plastic cartridge body having a pair of slots extending through the body and a pair of tabs extending away from the slots, compliant power contacts positioned in the slots and extending from the end of plastic cartridge body, a compliant thermal contact/retention clip inserted over the tabs comprising a thermally conductive spring-like material; and wherein an end of the contact cartridge assembly that includes the retention clip is configured to be received in the heat sink counterbore so that the retention clip engages retention features of the heat sink body;

a miniature LED, the miniature LED including a heat pad and power pads;

wherein the miniature is LED is positioned in the aperture of the heat sink body and is captured between the contact cartridge assembly and the heat sink body when the retention clip engages the retention feature of the heat sink body; and wherein the contact cartridge assembly exerts a force on the LED engaging the compliant power contacts of the contact cartridge assembly with the LED power pads and the thermal contact region of the retention clip with the LED heat pads.

12. The assembly of claim 11 wherein the heat sink body has a concave conical face at the end opposite the counterbore.

13. The assembly of claim 12 wherein the conical face is coated with a reflective material.

14. The assembly of claim 11 wherein the heat sink body is a material selected from the group consisting of a thermally conductive metal and a thermally conductive resin.

15. The assembly of claim 14 wherein the thermally conductive metal is selected from the group consisting of stainless steel, copper and its alloys and aluminum and its alloys.

16. A heat-dissipating housing for a miniature electronic component, the housing comprising:

a connector back comprising a plurality of connector back apertures and an electrical conductor, the plurality of connector back apertures comprising a first connector back aperture and a second connector back aperture;

a thermally-conductive reflector configured to overlay the connector back, the thermally-conductive reflector comprising:

a periphery;

a center pad joined to the periphery by a plurality of arms, the center pad comprising a surface configured to contact a thermally-conductive component of a miniature electronic component; and a plurality of reflector apertures interposed among the plurality of arms, the plurality of reflector apertures comprising a first reflector aperture and a second reflector aperture;

a lens overlaying the thermally-conductive reflector, the lens comprising:

a miniature electronic component comprising a thermally-conductive component;

a first latch comprising a first end configured to pass through the first reflector aperture and engage the first connector back aperture; and a second latch comprising a second end configured to pass through the second reflector aperture and engage the second connector back aperture;

wherein the latches retain the connector back, the thermally-conductive reflector, and the lens in an assembly; and wherein the latches urge the center pad into contact with the thermally-conductive component.

17. The housing of claim 16, the first latch further comprising a tooth proximate the first end, and the first connector back aperture comprising an interior surface having a mating ledge, the tooth and the mating ledge being configured such that the tooth engages the mating ledge upon insertion of the first end in the first connector back aperture.

18. The housing of claim 17, the first latch further comprising a second tooth distal the first end, the periphery comprising a tab bordering the first reflector aperture, the second tooth and the tab being configured such that the second tooth engages the tab upon passing the first end through the first reflector aperture.

19. The housing of claim 18, wherein the first tooth and the second tooth project radially and in substantially opposite directions.

20. The housing of claim 16, wherein the miniature electronic component is an LED.

* * * * *